US007357067B2

(12) United States Patent
Galba

(10) Patent No.: US 7,357,067 B2
(45) Date of Patent: Apr. 15, 2008

(54) SPHERICAL JOINT OF A HYDROSTATIC PISTON MACHINE

(75) Inventor: Vladimir Galba, Nova Dubnica (SK)

(73) Assignee: Poclain Hydraulics, Verberie (FR)

( * ) Notice: Subject to any disclaimer, the term of this patent is extended or adjusted under 35 U.S.C. 154(b) by 251 days.

(21) Appl. No.: 11/214,249

(22) Filed: Aug. 29, 2005

(65) Prior Publication Data

US 2007/0028762 A1 Feb. 8, 2007

(30) Foreign Application Priority Data

Aug. 5, 2005 (EP) ..... 05291678

(51) Int. Cl.
*F01B 3/00* (2006.01)

(52) U.S. Cl. ..... 92/71; 92/12.2

(58) Field of Classification Search ..... 92/71, 92/57, 12.2, 158, 160, 187
See application file for complete search history.

(56) References Cited

U.S. PATENT DOCUMENTS 3,006,324 A * 10/1961 Shaw ..... 92/160
3,707,113 A 12/1972 Hein et al.
3,726,189 A * 4/1973 Rubery ..... 91/506
3,866,518 A 2/1975 Miyao et al.
3,986,439 A * 10/1976 Ring ..... 92/158
5,724,733 A * 3/1998 Engel et al. ..... 92/187
5,758,566 A 6/1998 Jepsen et al.
6,024,010 A 2/2000 Kato et al.
6,168,389 B1 1/2001 Fukushima
6,343,888 B1 * 2/2002 Huhn et al. ..... 403/133
6,406,271 B1 * 6/2002 Valentin ..... 91/499

FOREIGN PATENT DOCUMENTS

DE 34 06 782 8/1984
DE 10314 654 10/2004
EP 0763657 B1 3/1998

* cited by examiner

*Primary Examiner*—Igor Kershteyn
(74) *Attorney, Agent, or Firm*—Ladas & Parry LLP

(57) ABSTRACT

A hydrostatic piston machine having a cylinder block with several cylinders, in which are slidably mounted pistons in load engagement with a reaction member via transmission members, each transmission member is connected to at least one of the piston or the reaction member via a spherical joint comprising a ball recess and a ball pivot comprising a convex spherical surface. The ball pivot has an ending rotational surface which is continuously connected to the convex spherical surface, created by rotating a continuous generating line around the axis of symmetry of the ball pivot, or at least one of the ball recess or the ball pivot has an end wall which is deformable under the loads acting on the spherical joint, so as to provide for an ending rotational surface having a curvature which is different from an initial curvature thereof.

20 Claims, 8 Drawing Sheets

SPHERICAL JOINT OF A HYDROSTATIC PISTON MACHINE

FIELD OF THE INVENTION

This invention relates to a spherical joint of a hydrostatic piston machine having a cylinder block with a plurality of cylinders, in which are slidably mounted pistons in load engagement with a reaction member via transmission members, each transmission member being connected to at least one of the elements constituted by a piston and by the reaction member via the spherical joint, the latter comprising a ball recess and a ball pivot comprising a convex spherical surface having a symmetry axis which is a longitudinal axis of the transmission member.

This machine can be a hydraulic motor or a hydraulic pump of the axial piston type. The reaction member is for example a swash-plate of which the inclination with respect to the cylinder block can be adaptable so as to change the active cylinder capacity of the machine, or fixed. The transmission members can be piston rods having spherical joints at both ends so that each transmission member is pivotably coupled to a piston at one end and to a sliding plate at the other end, in a sliding motion of the sliding plate on the reaction member in relative rotation. Alternatively, the transmission members can have the spherical joints at one end only. For example, each transmission member can be connected to a piston by a spherical joint at one end while being connected at the other end to a slipper, sliding on the swash plate. In this case, the transmission members and the slipper are fixed together so as to be part of a same rotating part. In another example, each transmission member can form an axial extension of a piston, said axial extension cooperating with the reaction member via a spherical joint.

BACKGROUND OF THE INVENTION

A generally known arrangement of a joint coupling for a hydrostatic piston machine has a ball pivot imbedded in a ball recess. In order to minimize the contact pressure between the ball pivot and the ball recess, both spherical surfaces of the ball pivot and the ball recess are manufactured in strict tolerances of their diameters which involves high manufacturing costs. Furthermore this arrangement is not adequate to reduce significantly the contact pressure between the spherical surfaces. In fact, especially due to technological reasons, in order to permit a circulation of fluid between the cylinders and the swash plate in any relative angle of inclination of the swash plate and the cylinder block, the ball pivot ends at a planar surface and the ball recess ends at a rotational recess, which is generally cylindrical, so the contact areas and consequently the most loaded areas of both spherical surfaces are on an edge, either on the circular edge of the rotational recess of the ball recess or on the circular edge of the planar surface of the ball pivot. Contact loads on edges are thus unfavourably high and consequently damages can occur due to unacceptable stresses.

An arrangement of a joint coupling for a hydrostatic piston machine is known by EP0763657 and has a ball pivot of the axial extension of a piston imbedded in a spherical ball recess of a slipper, the bottom of which presents a conical surface continuously connected to the spherical surface. Although this arrangement partially decreases the contact pressure between the ball pivot of the piston and the ball recess of the slipper, accuracy requirements and costs for the manufacture of this arrangement are as high as in the previously known arrangement. In this case when tolerances are large, the diameter of the contact area can be reduced and loads consequently increased. Moreover, this arrangement becomes less efficient as the angle of inclination of the slipper axis with respect to the piston axis increases, as a consequence of the eccentric influence of a force applied from the piston towards the contact circle defined by the intersection of the spherical surface of the ball pivot and the conical surface of the ball recess in the slipper. When this angle of inclination is increased, the axial force transmitted from the piston to the transmission member is considerably off-centred with respect to the joint surface of the ball recess. Accordingly, the contact area on the annular surface around the circle defined by the intersection of the spherical surface of the ball pivot and the conical surface of the ball recess is no longer complete, but is limited to a portion of this annular surface. Resulting stresses are consequently increased.

U.S. Pat. No. 6,024,010 discloses another known arrangements of joint couplings for an axial piston machine have a spherical ball recess, which receives a shoe (or slipper). In a first embodiment, the functional surface of the shoe is created by a substantially spherical surface having a radius of curvature equal or slightly smaller than that of the recess, a top portion of said substantially spherical surface having a larger radius of curvature. In a second embodiment, this functional surface has a generatrix formed by two eccentric arcs of circles, having a radius smaller than the radius of the recess and intersecting on an axis of symmetry at the top portion. U.S. Pat. No. 6,168,389 discloses a joint coupling for which the functional surface of the shoe (or slipper) is created by the rotation of a part of an ellipse around an axis of rotation of the shoe (or slipper).

The disadvantage of the arrangements of U.S. Pat. No. 6,168,389 and of the second embodiment of U.S. Pat. No. 6,024,010 is an unacceptably large radial clearance on both sides of the contact area between the respective functional surfaces of the ball recess and of the shoe (or slipper), which prohibits an application of these arrangements for a transmission of a radial force by means of the joint coupling if the axial force is not sufficient to keep the two adjacent surfaces in contact, in which case the radial clearance allows the shoe to move in the radial direction. Consequently, impacts due to vibrations may occur and damage the machine. In the arrangement of the first embodiment of U.S. Pat. No. 6,024,010, the disadvantage is that there is still an edge effect because the intersection of two spheres the centers of which are on the same axis is an edge.

SUMMARY OF THE INVENTION

The invention seeks to substantially overcome the above mentioned disadvantages of the prior art.

In this view, according to a first embodiment, the invention proposes a spherical joint of a hydrostatic piston machine having a cylinder block with a plurality of cylinders, in which are slidably mounted pistons in load engagement with a reaction member via transmission members, each transmission member being connected to at least one of the elements constituted by a piston and by the reaction member via the spherical joint, the latter comprising a ball recess and a ball pivot comprising a convex spherical surface having an axis of symmetry which is a longitudinal axis of the transmission member, wherein the ball pivot has an ending rotational surface which is continuously connected to the convex spherical surface and which is created by a rotation of a continuous generating line around the axis of symmetry.

Advantageously, at least a portion of the continuous generating line of the ending rotational surface is an arc of a circle, the radius of which is smaller than a radius of the convex spherical surface.

Advantageously, at least a portion of the continuous generating line of the ending rotational surface has a curvature defined by subtracting coordinates of a curve such as a logarithmic curve from coordinates of an arc of a circle. In this case, it is advantageous that the continuous generating line of the ending rotational surface has a curvature defined by subtracting coordinates of a curve such as a logarithmic curve from coordinates of an arc of a circle of which the radius is the radius of said spherical surface.

The generating line of the ending rotational surface can also be any curve, with a radius of curvature progressively decreasing from the radius of the convex spherical surface.

Advantageously, the ending rotational surface is connected to the convex spherical surface on a connecting circle and a connecting line between any point of this circle and a centre of the spherical surface defines with the axis of symmetry an angle in the range of 20° up to 40°. In this case, advantageously, the connecting circle is defined in a plane which is perpendicular to said axis of symmetry.

Due to the absence of sharp edge, the choice of said angle, which allows the determination of the position of the contact area of the ball recess on the ball pivot, and also due to the curved shape of this contact area on the ball pivot, the arrangement allows a radial clearance between the ball pivot and the ball recess, which is between 2 and 3 times larger than that of the present known arrangements for the same applications. Thus tolerances on the dimensions of the parts can be increased and consequently manufacturing costs can be reduced.

Moreover the arrangement of the spherical joint according to the invention for a hydrostatic piston machine decreases by between 2 and 2.5 times the contact pressure of the joint coupling due to the fact that, whatever is the tilt angle of the axis of the transmission member with respect to the axis of the piston or to the axis of the reaction member, the axial force transmitted from the piston is always applied on a contact area which is substantially annular with a curved profile defined by the generating lines said curved profile being for example an arc of circle or nearly an arc of circle. At the same time, due to the absence of sharp edges, this arrangement eliminates edge pressures on an end of a contact surface between the ball pivot and the ball recess, and consequently a lubrication of the contact surfaces is improved and the friction and wear of the joint coupling are significantly reduced.

According to a second embodiment, the invention proposes a spherical joint of a hydrostatic piston machine having a cylinder block with a plurality of cylinders, in which are slidably mounted pistons in load engagement with a reaction member via transmission members, each transmission member being connected to at least one of the elements constituted by a piston and by the reaction member via the spherical joint, the latter comprising a ball recess and a ball pivot comprising a convex spherical surface having an axis of symmetry which is a longitudinal axis of the transmission member, wherein at least one of the elements constituted by the ball recess and by the ball pivot has an end wall which is deformable under the loads acting on the spherical joint due to the working of said machine, so as to provide for an ending rotational surface having a curvature which is different from an initial curvature of said surface.

Advantageously, said deformable end wall is adjacent to a rotational recess formed in the ball pivot and/or in a space adjacent to the ball recess.

Advantageously, at least a most deformable portion of said deformable end wall has a thickness in the range of 5% to 20% of the diameter of said convex spherical surface.

Advantageously, said deformable end wall has a thickness that varies along said wall while increasing as the diameter of the rotational recess increases.

Advantageously, said rotational recess has a maximum diameter in the range of 30% to 65% of the diameter of said spherical surface.

When the fluid pressure force on the piston is transmitted to the spherical joint and when, consequently, the axial component of said force is applied on the ball pivot, the arrangement according to the second embodiment of the invention allows for a deformation of the deformable wall so that the contact area between the ball recess and the ball pivot moves from a circular edge towards an annular area formed on the modified ending surface, said modified surface being a substantially rotational which medium diameter is substantially the diameter of the rotational recess arranged to constitute the deformable wall.

Thus, the position of the contact area, which is the most loaded area of the spherical joint, is well defined. Consequently the arrangement of the spherical joint according to the second embodiment of the invention decreases 2 up to 2.5 times the contact pressure on the joint coupling generated by the axial force generated by the piston. This contact pressure does not depend on the inclination of the axis of the transmission member with respect to the axis of the piston, or with respect to the axis of the reaction member.

Furthermore the contact pressure in the loaded area decreases as a consequence of the elastic deformation of the wall between the rotational recess and the adjacent spherical surface. As the surface of the thus deformed wall is continuously connected to the spherical surface of the ball recess or the ball pivot as the case may be, this arrangement also eliminates edge pressures on an end of a contact surface between the ball pivot and the ball recess. Therefore, lubrication of the contact surface is improved and friction and wear of the joint decrease.

BRIEF DESCRIPTION OF THE DRAWINGS

Examples of an arrangement of a spherical joint for a hydrostatic piston machine of this invention are illustrated on attached FIGS. 1 to 6, wherein.

DESCRIPTION OF THE PREFERED EMBODIMENTS

Figure 1:
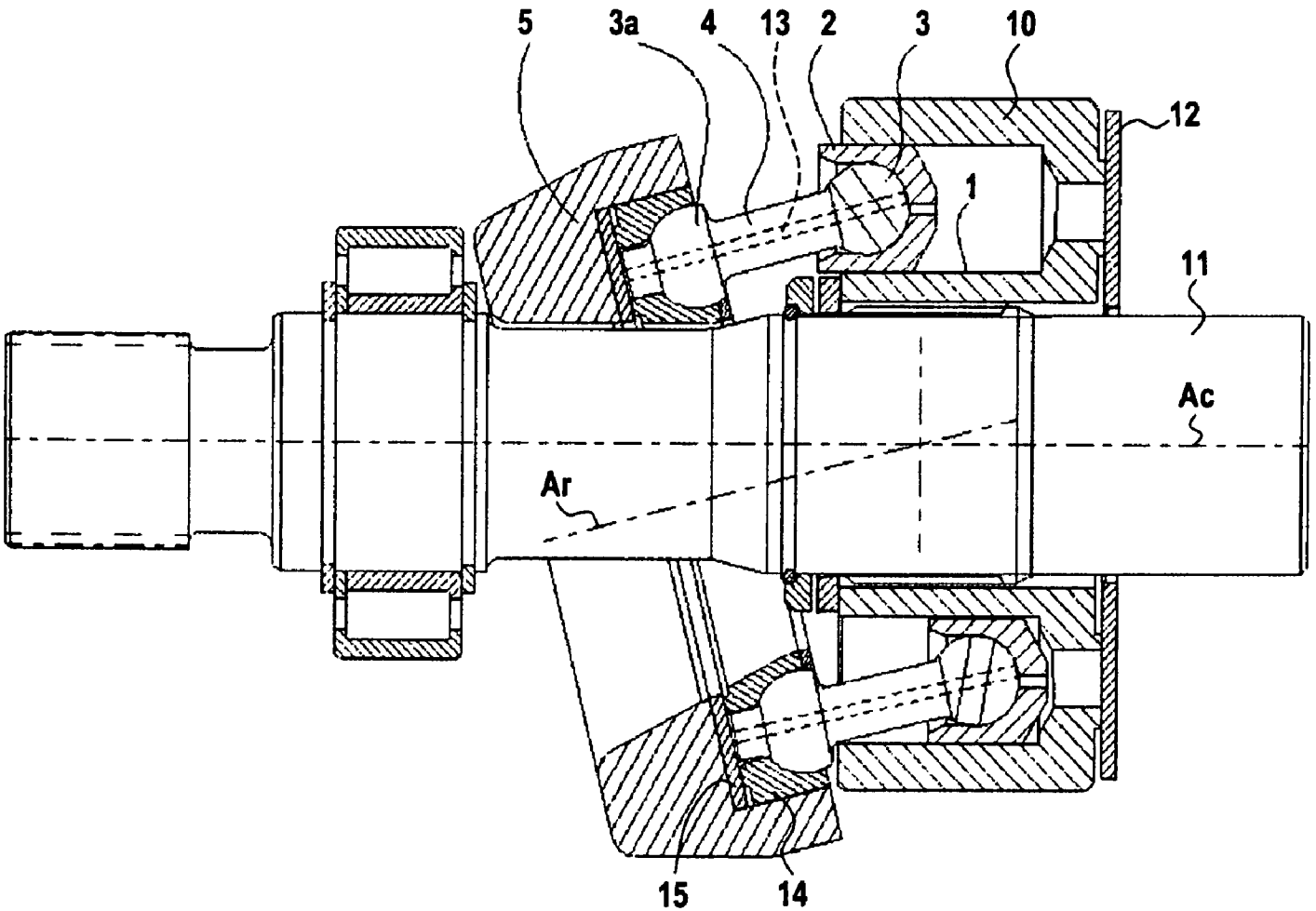
FIG. 1 is a longitudinal cross-section of an internal part of a swash plate type axial piston machine, where a force is transmitted from a piston onto a swash plate by means of a piston rod and a bearing plate.

FIG. 1 shows a hydrostatic piston machine comprising a housing (not shown), a cylinder block (10) in rotational engagement with a shaft (11). Pistons (2) are reciprocally and slidably mounted in cylinders (1) of the cylinder block. During the rotation of the cylinder block, the cylinders are alternatively connected to fluid main ducts (not shown) via a distribution plate (12). The force generated by the fluid pressure inside the cylinders (1) is transmitted from the pistons (2) through transmission members (4) onto a reaction member (5). Therefore, the pistons are in load engagement with the reaction member.

In the example shown, the reaction member (5) is a control member having an axis Ar making a constant or variable angle (a) with respect to the axis of rotation Ac of the cylinder block (1). This angle determines the value of the strokes of the pistons (2) and the displacement volume of the machine. The pistons (2) and the transmission members (4) have through holes (13) on their respective axes for lubrication and hydrostatic balance of the machine.

In a swash plate type axial piston machine illustrated on FIG. 1, the reaction member (5) is a swash plate and the transmission member (4) for each piston is a piston rod. A first spherical joint (3) connects the piston (2) with the connecting rod (4). A second spherical joint (3*a*) connects the piston rod (4) with a sliding plate (14) which slides on a surface of the swash plate (5) via a bearing plate (15) as the cylinder block rotates.

Figure 2:
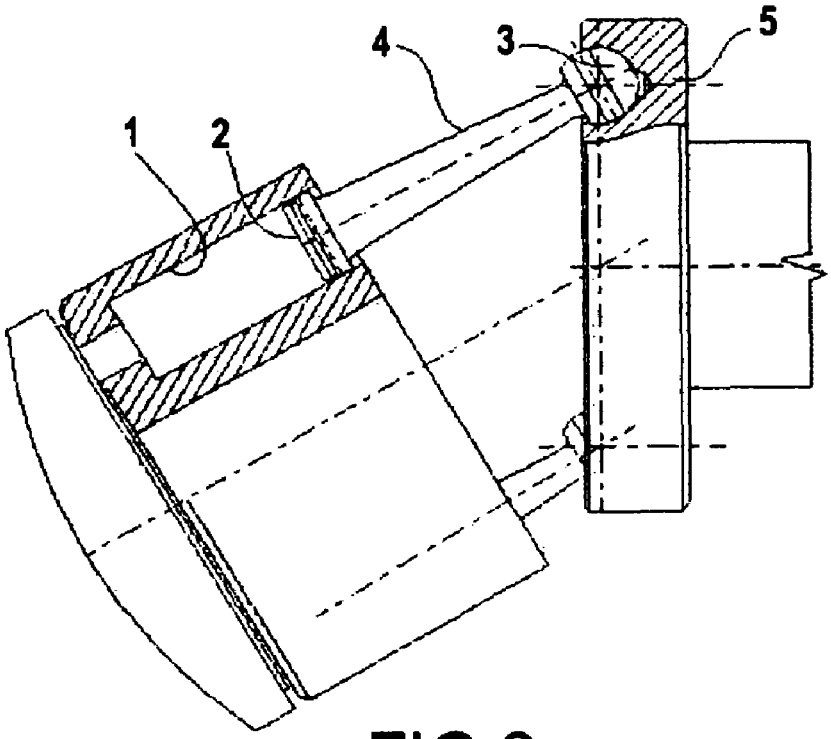
FIG. 2 is a longitudinal cross-section of an arrangement of an internal part of an axial piston machine of the bent axis design.

In a bent axis type axial piston machine as illustrated on FIG. 2, the rotation axis of the cylinder block (10) is bent with respect to the rotation axis of the reaction member (5), the angle formed between these axes can be fixed or variable (in which case the cylinder block is inclinable) and determines the value of the strokes of the pistons and the displacement volume of the machine. In this example, the piston (2) is an integrated part of the transmission member (4). More precisely, the transmission member forms an axial extension of the piston, said axial extension cooperating with the reaction member (5) via a spherical joint (3).

Figure 3:
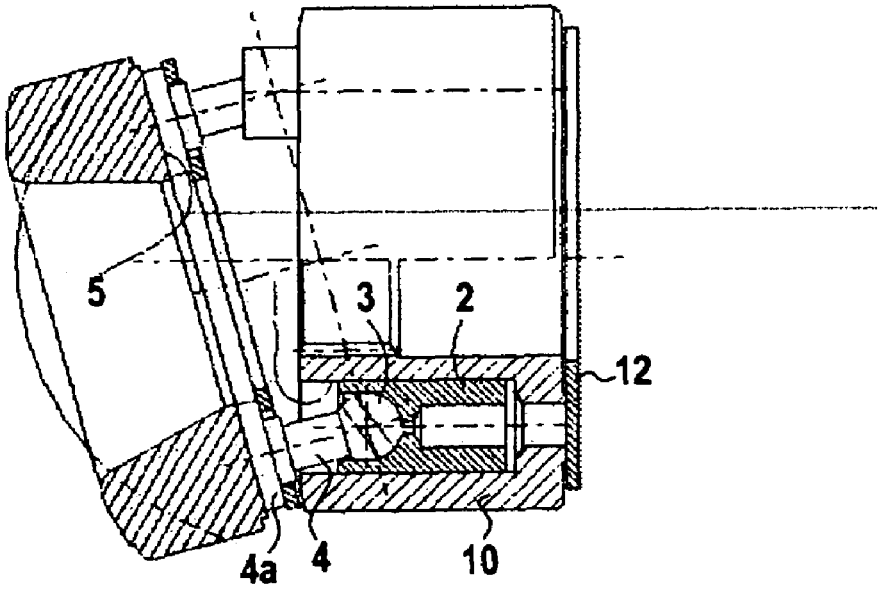
FIG. 3 is a longitudinal cross-section of an arrangement of an internal part of a swash plate type axial piston where a force is transmitted from a piston onto a swash plate by means of a slipper.

In the swash plate type axial piston machine illustrated on FIG. 3, each transmission member (4) is linked to a corresponding piston by a spherical joint (3) at one end while being linked at the other end to a slipper (4*a*), sliding on the swash plate (5). The transmission members (4) and the slipper (4*a*) are fixed together so as to be part of a same rotating part.

The invention is applicable to the spherical joints (3, 3*a*) of these three examples.

The first embodiment of the invention is described hereinbelow in reference to FIGS. 4 to 6.

Figure 4:
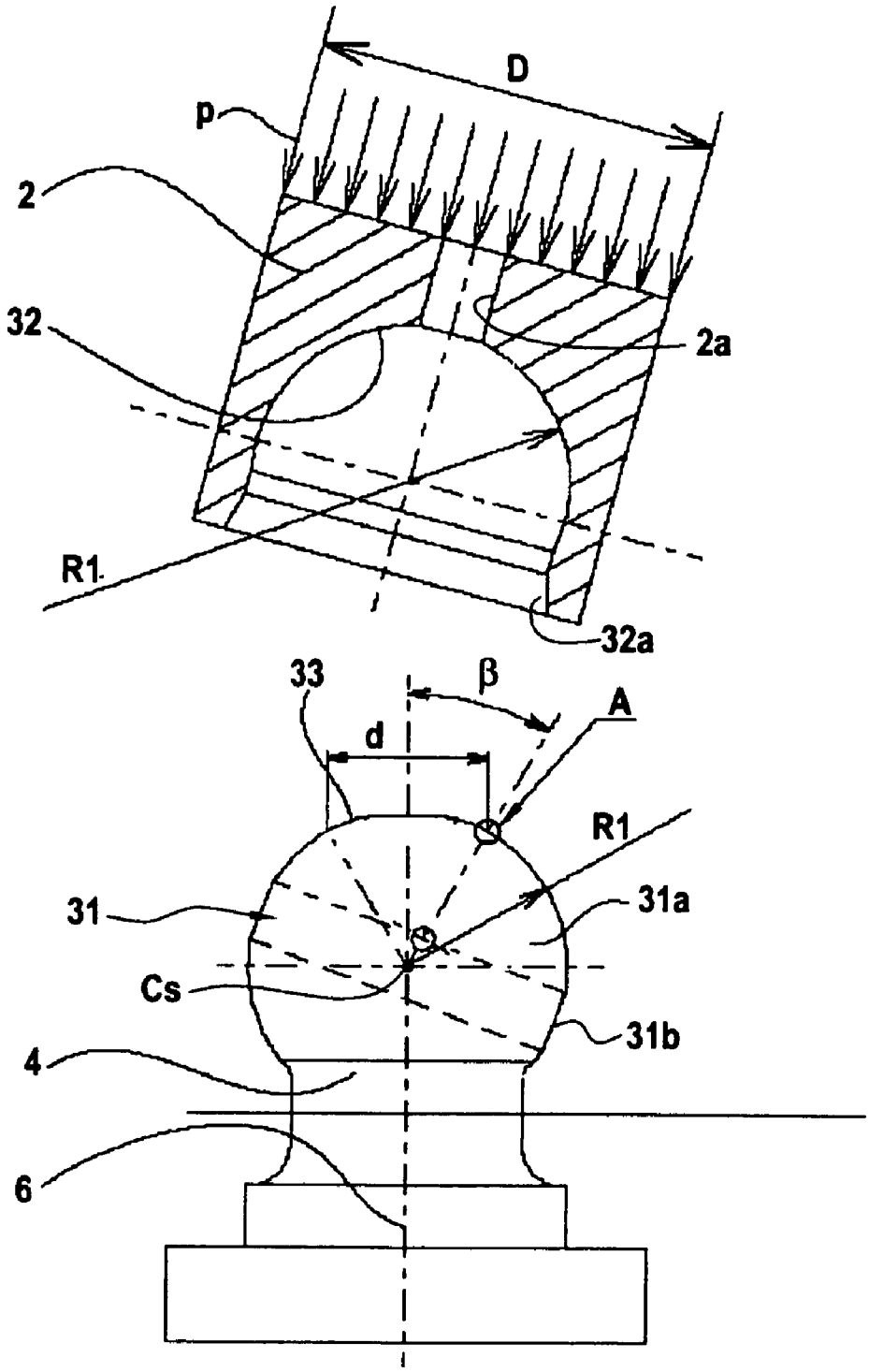
FIG. 4 is an enlarged fragmentary view of a spherical joint of an axial piston machine according to the first embodiment of the invention according to FIG. 3.

As it can be seen on FIG. 4, a spherical joint (3) comprises a ball recess (32) and a ball pivot (31). The ball recess essentially has a spherical shape, its edge 32*a* being somewhat flared. The nominal value of radius (R1) of the ball recess (32) which essentially has a spherical shape is equal to the nominal value of radius (R1) of the ball pivot (31) and their real values are different due to a necessary radial functional clearance and manufacturing tolerances.

According to the invention the ball pivot (31) consists of a convex part (31*a*), which is substantially spherical. As seen on the drawing, a portion (31*b*) of the outer surface of this part can depart from a sphere, while being flattened so as to locally have the shape of a cylinder based on a circle, in order to facilitate the mounting of the convex part (31*a*) into the ball recess (32). Nevertheless, on most of its surface, the ball pivot has a spherical surface, which means that this surface is mostly formed on a sphere having a radius R1 and for which the longitudinal axis (6) of the transmission member (4) is a symmetry axis.

This spherical shape is also altered at the outer end of the ball pivot. More precisely, a circle of diameter (d) is defined by the intersection of the sphere of radius R1 with a cone, the summit of which is the centre (Cs) of the sphere, the axis of which is the longitudinal axis (6) of the transmission member (4) and the generatrix of which heads towards the outer end of the ball pivot (31) (opposite to the piston) and defines with said axis (6) an angle (β).

Beyond the said circle of diameter (d) the convex surface (31*a*) of the ball pivot (31) departs from the sphere of radius R1, while having an ending convex rotational surface (33) which has a curvature different from the curvature of said sphere.

Figure 5:
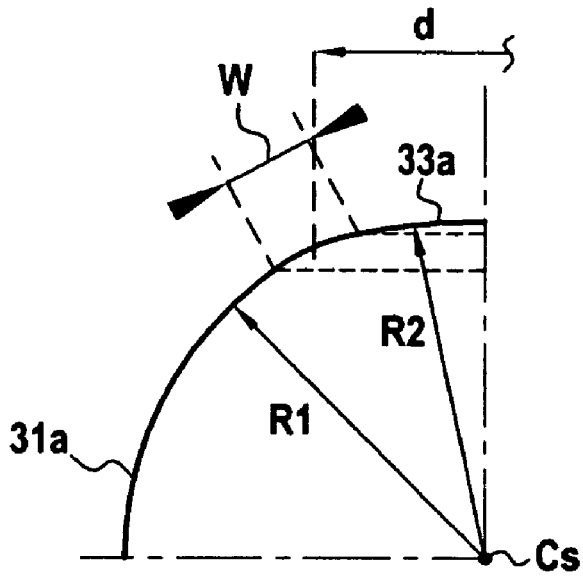
FIG. 5 and FIG. 6 are enlarged diagrammatic views showing two possible shapes for the generating line of an ending rotational surface.

As shown on FIG. 5, this ending rotational surface (33) can have the generating line thereof formed by an arc of a circle (33*a*) with a radius (R2), which is slightly smaller than the radius (R1).

Figure 6:
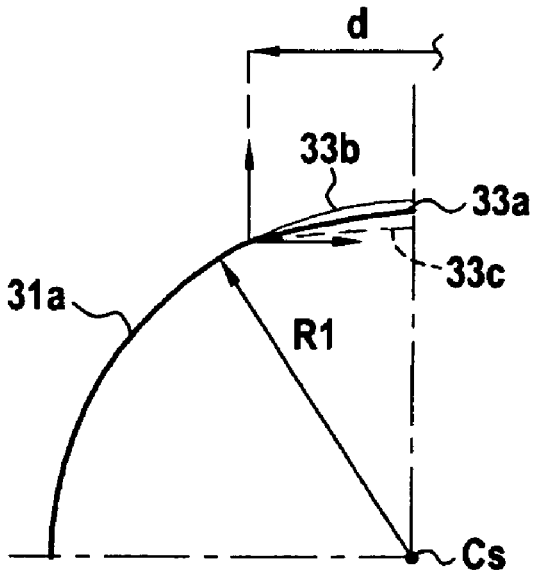

As shown on FIG. 6, the ending convex rotational surface (33) can also have its generating line formed by a curve (33*a*) which is determined from an arc of a circle (33*b*), the radius of which is equal to the radius (R1), while subtracting the coordinates of a modifying curve (33*c*) starting at zero on the above-mentioned circle of diameter (d), so that the radius of curvature of the generating line decreases from R1. For example, this modifying curve can be determined as a logarithmic function or any other mathematical function providing a smoothly increasing Y-axis coordinate, with Y-axis perpendicular to the ball pivot axis. In the meaning of the invention, such other mathematical function is considered as a curve such as a logarithmic curve.

Whatever the exact shape of the ending rotational surface (33), it is continuously connected to the convex spherical surface (31*a*) without forming any sharp edge.

When a loading force is applied on the spherical joint of the hydrostatic piston machine according to this invention, a contact between the ball recess (32) and the ball pivot (31) occurs on an annular surface having the diameter (d) of the above mentioned circle as its medium diameter, where:

$$d=2R_1\times\sin(\beta).$$

The width (w) of this annular contact area depends firstly on the value of the loading force, secondly on the materials in which the contacting surfaces of the ball pivot (31) and the ball recess (32) are formed and thirdly on real geometric dimensions of the joint coupling (3), which real dimensions are determined from spheres having the radius R1, taking manufacturing tolerances into account. The value of the axial loading force decreases, when angle (β) increases, as a consequence of an influence of hydrostatic pressure on a surface bounded approximately by the medium diameter (d) of the contact area. Besides, the contact force increases proportionally with the value: 1/cos β.

Figure 11:
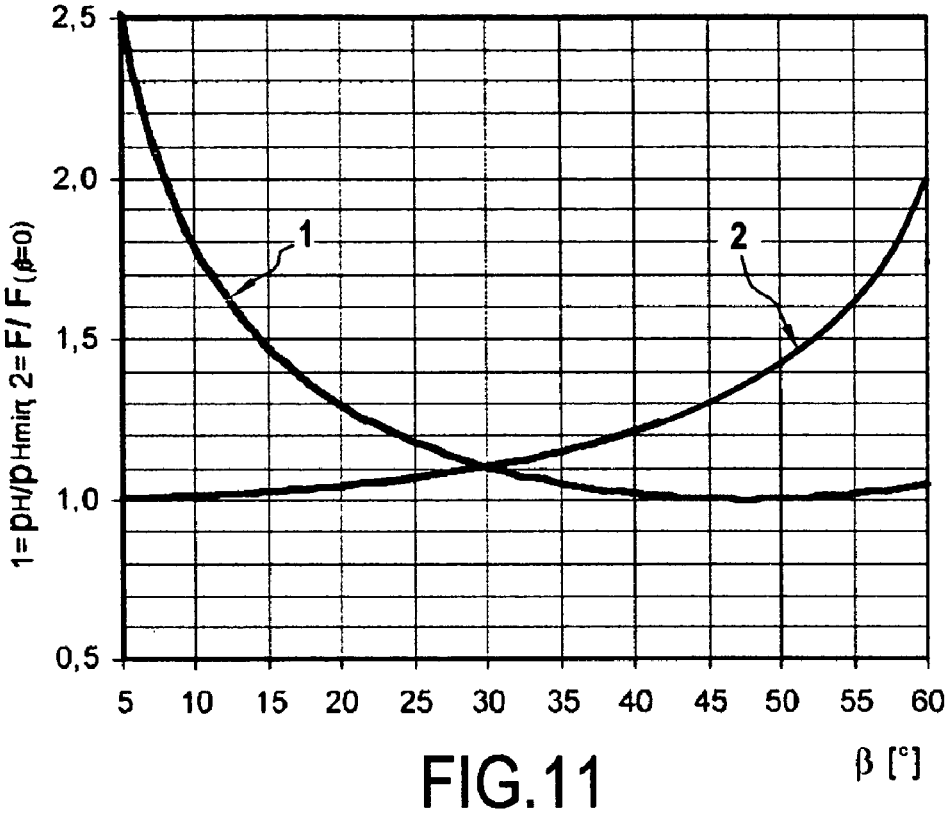
FIG. 11 is a graph of a relative value of a contact pressure and a relative value of a force in a contact area as functions of an angle (β).

FIG. 11 shows the variation of relative values of loading forces $F/F_0$, where $F_0$ is a loading force by β=0° versus the angle (β) of the contact area (curve 2), and the variation of relative values of contact forces $p_H/p_{HMIN}$, where $p_{HMIN}$ is the minimum value of the contact force, versus this angle (β) (curve 1). In this example, these characteristics are determined firstly for both parts of the spherical joint manufactured from steel and secondly for the following ratio:

$$\frac{2R_1}{D} = 0{,}75,$$

where D is the diameter of the piston (2).

The intersection of both curves on FIG. 11 defines the value of angle (β), which is the best compromise to get the contact force and the loading force as low as possible and consequently to get a low value of the friction in the spherical joint.

The invention allows for a radial clearance, having a value which can be as big as twice the usual value for generally known hydrostatic piston machines. The value of the friction coefficient in the spherical joint of the invention is positively influenced by a presence of pressurized fluid in the contact area and consequently the lifetime of the connection is also improved. For a spherical joint (such as 3 on FIG. 1) connecting a transmission member to the corresponding piston, such a pressurized fluid shown by arrows (p) in FIG. 4 is directly obtained from the fluid under pressure in the cylinder (1) in which said piston slides, going through a through hole (2*a*) formed in the bottom part of said piston. For a spherical joint (such as 3*a* on FIG. 1) connecting a transmission member to the reaction member, such a pressurized fluid can be obtained from the fluid under pressure in the cylinder (1), in which the piston corresponding to said transmission member slides, via the through hole (2*a*) of the bottom part of said piston and via the through hole (13) of this transmission member. Values of the Hertz—contact pressure for two different values of a radial clearance between the ball recess (32) and the ball pivot (31) as a function of the angle (β) of the contact area are illustrated on FIG. 12. The most advantageous area of the angle (β) of the contact area, deducted from both FIGS. 11 and 12, lies between 20° and 40°.

Moreover the double clearance allows larger tolerances on the dimensions of the parts and consequently production costs can be reduced.

The second embodiment of the invention is described herein-below in reference to FIGS. 7 to 10.

Figure 7:
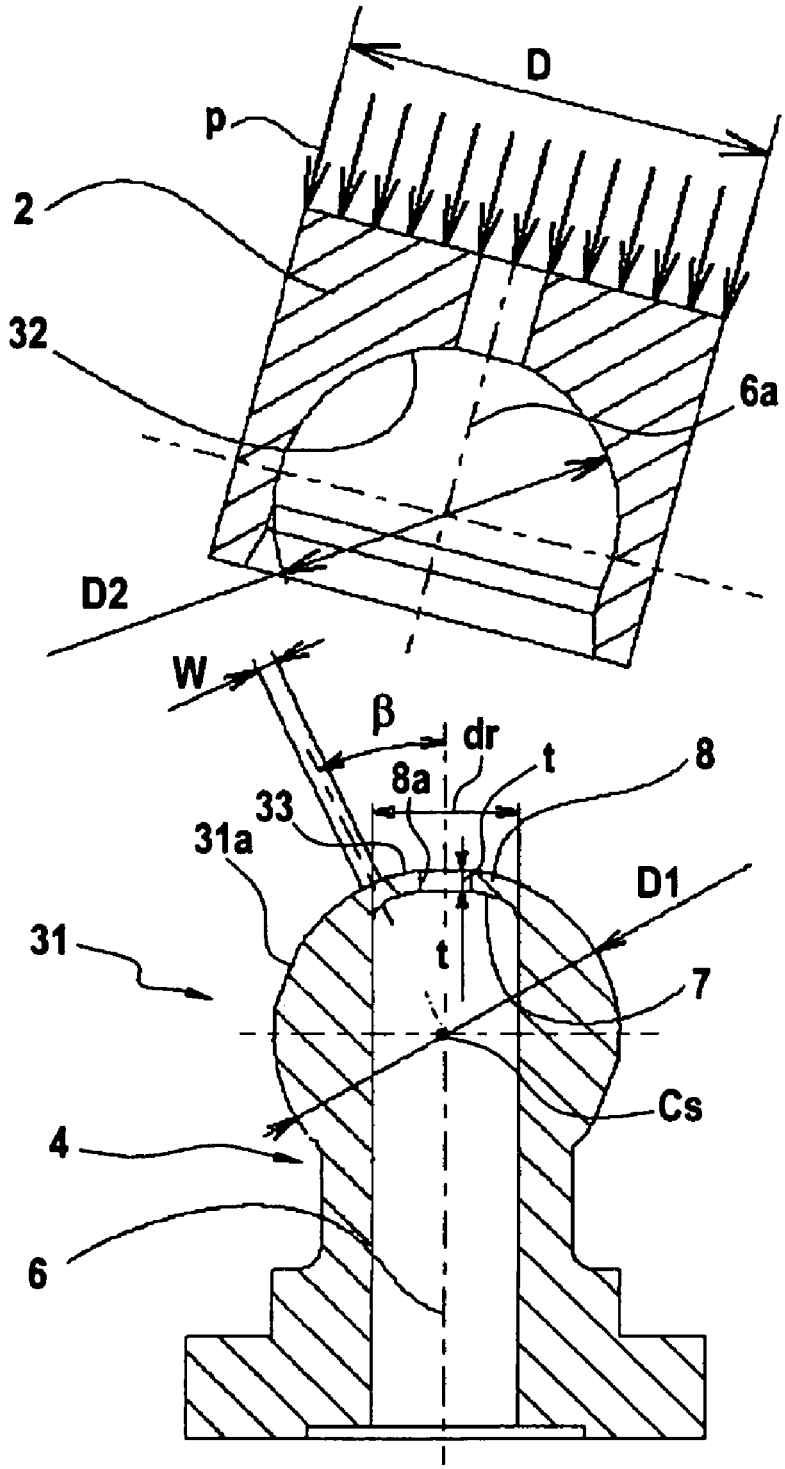
FIG. 7 is an enlarged fragmentary view of a spherical joint for an axial piston machine showing a first possible arrangement according to the second embodiment of the invention, wherein a rotational recess is created in a space adjacent to a convex spherical surface of a ball pivot.

As seen on FIG. 7, a spherical joint (3) according to the second embodiment of the invention comprises a ball recess (32) of diameter D2 formed in a first part consisting of a cylindrical piston (2) with a diameter D and an axis (6*a*), and a ball pivot (31) with a diameter D1 and an axis (6) formed in a second part consisting of a slipper (4) of a hydrostatic piston machine as illustrated on FIG. 3. The axis (6) is an axis of symmetry of the globally convex spherical surface (31*a*) of the ball pivot and a longitudinal axis of the transmission member 4 provided with the said ball pivot. Although diameters D1 and D2 have the same nominal value, thereafter D1, D2 is slightly larger than D1 due to necessary functional clearance and tolerances.

In this joint coupling a rotational recess (7), which is coaxial with the slipper, is created in the ball pivot (31) in a space adjacent to the convex spherical surface (31*a*) so that an end wall of the ball pivot is an elastically deformable wall (8) formed between said rotational recess (7) and the adjacent part of the convex spherical surface (31*a*).

This wall can thus be deformed under the loads acting on the spherical joint due to the working of the hydrostatic machine, so as to provide for an ending rotational surface (33) having a curvature which is different from the initial curvature of said surface. The initial curvature is the curvature of this surface under no load, commonly the curvature of the sphere having the diameter D1.

The above-mentioned diameter dr of the rotational recess (7) is the maximum diameter thereof. In the example shown, this rotational recess essentially has the shape of a cylinder based on a circle of diameter dr. The end wall (8) delimits the recess (7) due to the curvature of said end wall, the diameter of the recess progressively decreases along said wall, starting from the said cylindrical surface. The thickness (t) of the wall (8) varies along the end wall (7) as the diameter of the recess varies. More precisely, this thickness increases as the diameter of the rotational recess increases, this variation being preferentially proportional or substantially proportional. The deformability of the end wall (7) is at its maximum where the thickness is minimum, the thickness of at least a most deformable portion of said deformable end wall being in the range of 5% to 20% of the diameter of the convex spherical surface.

The rotational recess (7) advantageously forms part of a lubrication through hole such as hole (13) of FIG. 1. To this aim, a through hole (8*a*) of small diameter is machined coaxial with the axis (6) in the wall (8). Said small diameter is for example in the range of 10% to 30% of diameter dr.

When the spherical joint (3) of the hydrostatic piston machine according to the invention is loaded by an axial force transmitted from the fluid pressure applied on the piston (2), the contact area between the ball recess (32) and the ball pivot (31) occurs approximately around a circle of diameter dr of the contact area of the rotational recess (7), where:

$$d = D1 \times \sin(\beta)$$

where (β) is the angle defined by the axis (6) of the ball pivot (31) and a generatrix of a cone, the summit of which is the centre (Cs) of the convex spherical surface (31*a*) and the intersection of which with the convex spherical surface (31*a*) forms a circle of diameter dr.

The width (w) of this annular contact area depends firstly on the value of the fluid pressure (p) applied on the piston (2), secondly on the materials in which the contacting surfaces of the ball pivot (31) and the ball recess (32) are formed and thirdly on real geometric dimensions of the joint coupling (3), which real dimensions are determined from spheres having the radius R1, taking manufacturing tolerances into account. The value of the axial loading force decreases, when angle (β) increases, as a consequence of an influence of hydrostatic pressure on a surface bounded approximately by the medium diameter (dr) of the contact area.

Tribological parameters of both adjoining parts (the ball pivot and the ball recess) are very important. In fact, a part of the force transmitted is also supported by a border surface of the wall (8), which is bounded by a diameter smaller than the diameter dr of the contact area as a consequence of the creation of the rotational recess (7) and of the elastic deformation of the wall (8) when an axial load is applied.

Value of axial loading decreases if the above-mentioned angle (β) increases, as a consequence of the influence of hydrostatic pressure on the surface bounded approximately by the medium diameter (dr) of the contact area. Besides, the contact force increases proportionally with the value 1/cos β.

As for the first embodiment of the invention, the variation of a relative value of a loading force $F/F_0$, where $F_0$ is a loading force by β=0°, and the variation of a relative value of a contact pressure $p_H/p_{HMIN}$, where pHMIN is the minimum value of the contact pressure pH, versus the angle (β) of the contact area, are illustrated on FIG. 11. These characteristics do not take acount of the influence of the elastic deformation of the wall (8) under load and consequently the contact pressure will be even lower. These characteristics are determined for both parts of the spherical joint manufactured from steel and for the following ratio:

$$\frac{D_1}{D} = 0{,}75.$$

The intersection of both curves on this figure defines a value of angle (β), which is the best compromise to get the contact pressure and the loading force as low as possible, and consequently a low value of friction in the spherical joint. The value of the friction coefficient in the spherical joint is favourably influenced by the presence of oil pressure in the contact area and consequently the lifetime of the connection is also improved.

Figure 12:
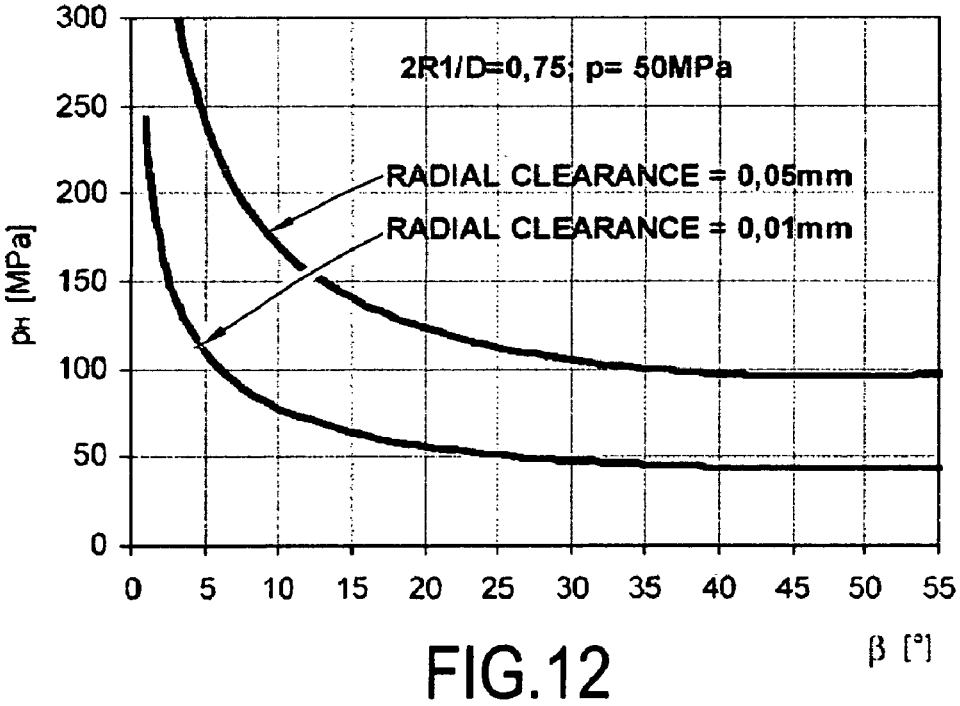
FIG. 12 is a graph of a contact pressure as a function of an angle (β) for different radial clearances in a joint.

As for the first embodiment, referring also to FIG. 12, the most advantageous area of the angle (β) of the contact area lies between 20° and 40°. This corresponds approximately with a percentage relation of the diameter (dr) of the rotational recess (7) to the first diameter (D1) of the ball pivot (31) in range 30% up to 65%.

Although nominal values of diameter (D1) of the ball pivot (31) and diameter (D2) of the ball recess (32) are equal, diameter (D2) is bigger than diameter (D1) due to functional clearance and production tolerances. With the arrangement of the spherical joint according to the second embodiment of the invention, values of production tolerances can be about two-times bigger than values of tolerances of existing spherical joints used for the same applications at the present time. Thus production costs can be reduced. Furthermore, the values of Hertz-contact pressure will be substantially lower in comparison with existing spherical joints and consequently lifetime of parts can be improved.

Figure 8:
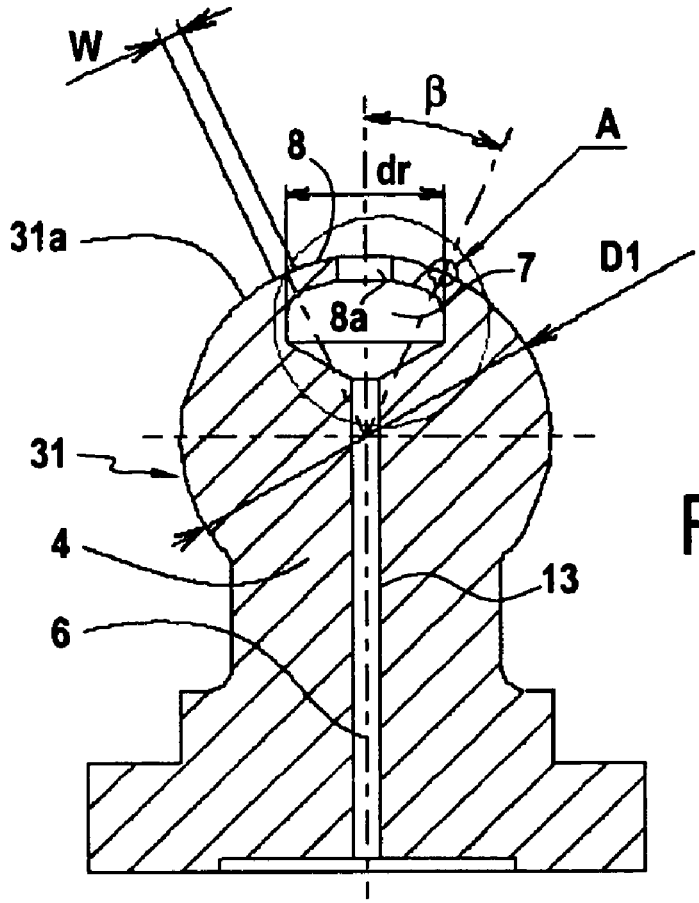
FIG. 8 is an alternative solution of the arrangement of the spherical joint illustrated on FIG. 7.
Figure 9:
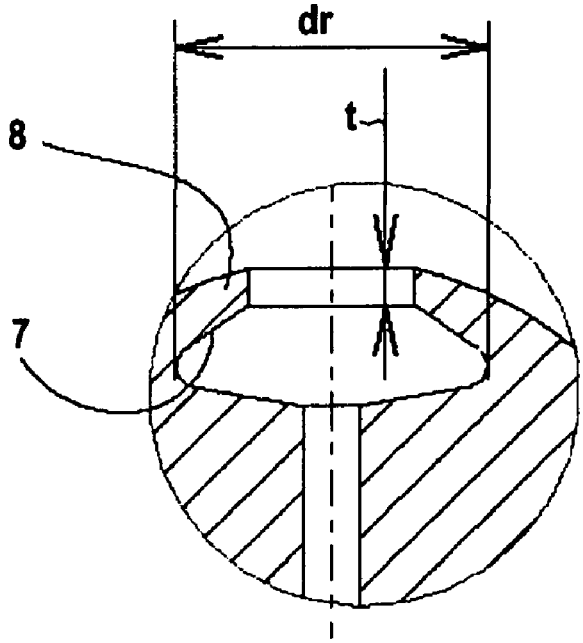
FIG. 9 is a detail of the rotational recess from FIG. 8.

FIGS. 8 and 9 show another example for the second embodiment of the invention, where the rotational recess (7) is also formed is the ball pivot (31) of a slipper (4), while being coaxial with the slipper. This rotational recess (7) is created in the slipper by machining or any other appropriate means from the head portion of the ball pivot before the wall (8) is pressed down in the position shown (which is its initial position in the meaning of the invention), for example with a tooling of an adapted shape during heat treatment of the slipper during a plastic state to form a spherical surface of diameter D1. In this example, the rotational recess (7) has a maximum diameter dr and forms an enlarged part of the through hole (13) of the slipper.

Figure 10:
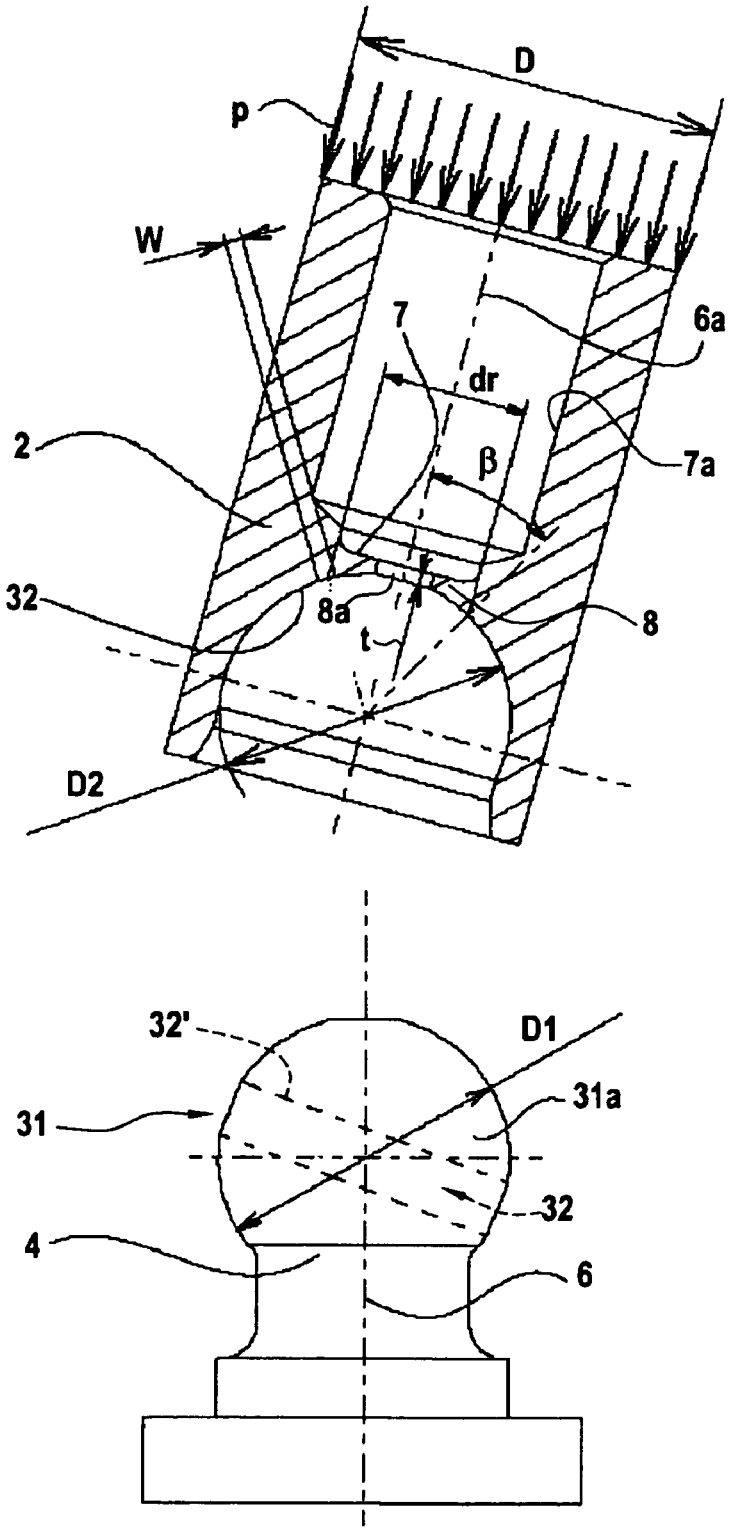
FIG. 10 is an enlarged fragmentary view of a spherical joint applied in an axial piston machine, showing a second possible arrangement according to the second embodiment of the invention, wherein a rotational recess is created in a space adjacent to a ball recess.

FIG. 10 shows still another example for the second embodiment of the invention, wherein the rotational recess (7) is created in a space adjacent to the contact area of the spherical surface 32' of the ball recess (32), which belongs to the piston (2) of diameter (D). In this example, the rotational recess (7) of nominal diameter (dr) is coaxial with the axis (6*a*) of piston (2) and is created so that an elastically deformable wall (8) is formed between the said rotational recess (7) and the adjacent part of the spherical surface (32*a*). Towards the inner end of the piston directed toward the bottom of the cylinder in which said piston slides, the rotational recess (7) is extended by a cavity opening on said inner end, so that the piston is substantially hollow.

A through hole (8*a*) of a small diameter is coaxial with the axis (6*a*) between the ball recess (32) and the rotational recess (7). Said small diameter is for example in the range of 10% to 30% of diameter dr.

In the examples shown on FIGS. 7 to 10, the ball pivot (31) belongs to a slipper (4), although, as indicated above, such a ball pivot according to the invention can also be formed at either end of the piston rod 4 of FIG. 1, or at the end of the transmission member 4 of FIG. 2 which is away from the cylinder 1. In the examples of FIGS. 8 to 10 also, the thickness of the deformable end wall (8) advantageously varies along said wall as described in reference to FIG. 7.

In addition to these described application possibilities, it is possible to utilise the arrangement of the spherical joint according to the invention for radial piston machines. Moreover the spherical joint according to invention can be advantageously used for a fluid pressure actuated piston of a servo control of the displacement of a hydrostatic piston machine. Advantageously the servo control pistons can be connected to the swash plate of a hydrostatic piston machine by connecting rods having one or preferably two spherical joints according to the invention, which are similar to the piston rods connecting the cylinder block to the swash plate of the machine.

The two embodiments of the invention are compatible with each other. More precisely, the spherical joint can have a ball pivot made according to the first embodiment, as shown for example in FIGS. 4 to 6 and a ball recess made according to the second embodiment, as shown for example in FIG. 10.

The invention claimed is:

1. A spherical joint of a hydrostatic piston machine having a cylinder block with a plurality of cylinders, in which are slidably mounted pistons in load engagement with a reaction member via transmission members, each transmission member being connected to at least one of the elements constituted by a piston and by the reaction member via the spherical joint, the latter comprising a ball recess and a ball pivot comprising a convex spherical surface having an axis of symmetry which is a longitudinal axis of the transmission member, the ball pivot having an ending rotational surface which departs from the convex spherical surface while being continuously connected therewith and is created by a rotation of a continuous generating line around the axis of symmetry.

2. A spherical joint of a hydrostatic piston machine according to claim 1, wherein at least a portion of the continuous generating line of the ending rotational surface is an arc of a circle a radius of which is smaller than a radius of the convex spherical surface.

3. A spherical joint of a hydrostatic piston machine according to claim 1, wherein at least a portion of the continuous generating line of the ending rotational surface has a curvature defined by subtracting coordinates of a curve from coordinates of an arc of a circle.

4. A spherical joint of a hydrostatic piston machine according to claim 1, wherein the continuous generating line of the ending rotational surface has a curvature defined by subtracting coordinates of a curve from coordinates of an arc of a circle of which the radius is the radius of said spherical surface.

5. A spherical joint of a hydrostatic piston machine according to claim 1, wherein the continuous generating line of the ending rotational surface is a curve, of which the radius of curvature is progressively decreasing from the radius of the convex spherical surface.

6. A spherical joint of a hydrostatic piston machine according to claim 1, wherein the ending rotational surface is connected to the convex spherical surface on a connecting circle, and a connecting line between any point of said connecting circle and a centre of the spherical surface defines with the symmetry axis an angle in the range of 20° to 40°.

7. A spherical joint of a hydrostatic piston machine according to claim 1, wherein the ball recess has en end wall which is deformable under the loads acting on the spherical joint due to the working of said machine, so as to provide for an ending rotational surface having a curvature which is different from an initial curvature of said surface.

8. A spherical joint of a hydrostatic piston machine having a cylinder block with a plurality of cylinders, in which are slidably mounted pistons in load engagement with a reaction member via transmission members, each transmission member being connected to at least one of the elements constituted by a piston and by the reaction member via the spherical joint, the after comprising a ball recess and a ball pivot comprising a convex spherical surface having an axis of symmetry which is a longitudinal axis of the transmission member, wherein the ball recess has an end wall formed between a rotational recess and the adjacent part of the convex spherical surface, said end wall being deformable under loads acting on the spherical joint due to the working of said machine, so as to provide for an ending rotational surface having a curvature which is different from an initial curvature of said surface.

9. A spherical joint of a hydrostatic piston machine according to claim 8, where in said deformable end wall is adjacent to said rotational recess, and said rotational recess formed in a space adjacent to the ball recess.

10. A spherical joint of a hydrostatic piston machine according to claim 9, wherein said deformable end wall has a thickness that varies along said wall while increasing as the diameter of the rotational recess increases.

11. A spherical joint of a hydrostatic piston machine according to claim 9, wherein said rotational recess has a maximum diameter in the range of 30% to 65% of a diameter of said spherical surface.

12. A spherical joint of a hydrostatic piston machine according to claim 9, wherein said deformable end wall has a thickness that varies along said wall while increasing as the diameter of the rotational recess increases.

13. A spherical joint of a hydrostatic piston machine according to claim 9, where in at least a most deformable portion of said deformable end wall has a thickness in the range of 5% to 20% of the diameter of said convex spherical surface.

14. A spherical joint of a hydrostatic piston machine having a cylinder block with a plurality of cylinders, in which are slidably mounted pistons in load engagement with a reaction member via transmission members, each transmission member being connected to at least one of the elements constituted by a piston and by the reaction member via the spherical joint, the latter comprising a ball recess and a ball pivot comprising a convex spherical surface having an axis of symmetry which is a longitudinal axis of the transmission member, wherein the ball pivot has an end wall which is deformable under loads acting on the spherical joint due to the working of said machine, so as to provide for an ending rotational surface having a curvature which is different from an initial curvature of said surface.

15. A spherical joint of a hydrostatic piston machine according to claim 14, wherein said deformable end wall is adjacent to a rotational recess formed in the ball pivot.

16. A spherical joint of a hydrostatic piston machine according to claim 15, wherein said rotational recess has a maximum diameter in the range of 30% to 65% of a diameter of said spherical surface.

17. A spherical joint of a hydrostatic piston machine according to claim 15, wherein at least a most deformable portion of said deformable end wail has a thickness in the range of 5% to 20% of the diameter of said convex spherical surface.

18. A spherical joint of a hydrostatic piston machine having a cylinder block with a plurality of cylinders, in which are slidably mounted pistons in load engagement with a reaction member via transmission members, each transmission member being connected to at least one of the elements constituted by a piston and by the reaction member via the spherical joint, the latter comprising a ball recess and a ball pivot comprising a convex spherical surface having an axis of symmetry which is a longitudinal axis of the transmission member, the ball pivot having an ending rotational surface which is continuously connected to the convex spherical surface, is created by a rotation of a continuous generating line around the axis of symmetry and is connected to the convex spherical surface on a connecting circle, a connecting line between and point of said connecting circle and a centre of the spherical surface defining the symmetry axis an angle in the range of 20° to 40°.

19. A spherical joint of a hydrostatic piston machine having a cylinder block with a plurality of cylinders, in which are slidably mounted pistons in load engagement with a reaction member via transmission members, each transmission member being connected to at least one of the elements constituted by a piston and by the reaction member via the spherical joint, the latter comprising a ball recess and a ball pivot comprising a convex spherical surface having an axis of symmetry which is a longitudinal axis of the transmission member, wherein the ball recess has an end wall formed between a rotational recess and the adjacent part of the convex spherical surface, said end wail being deformable under loads acting on the spherical joint due to the working of said machine, so as to provide for an ending rotational surface having a curvature which is different from an initial curvature of said surface, the thickness of the end wall varying along the wall as the diameter of the recess varies.

20. A spherical joint of a hydrostatic piston machine having a cylinder block with a plurality of cylinders, in which are slidably mounted pistons in load engagement with a reaction member via transmission members, each transmission member being connected to at least one of the elements constituted by a piston and by the reaction member via the spherical joint, the latter comprising a ball recess and a ball pivot comprising a convex spherical surface having an axis of symmetry which is a longitudinal axis of the transmission member, wherein the ball pivot has an end wall which is deformable under loads acting on the spherical joint due to the working of said machine, so as to provide for an ending rotational surface having a curvature which is different from an initial curvature of said surface, the thickness of the end wall varying along the end wall as the diameter of the recess varies.

* * * * *